US008816230B2

(12) United States Patent
Fang et al.

(10) Patent No.: US 8,816,230 B2
(45) Date of Patent: Aug. 26, 2014

(54) MICRO-SWITCH PROVIDED LABOR-SAVING SWITCHING

(75) Inventors: Ding-Jie Fang, New Taipei (TW); Gang-Wei Liao, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 273 days.

(21) Appl. No.: 13/492,325

(22) Filed: Jun. 8, 2012

(65) Prior Publication Data

US 2013/0327622 A1 Dec. 12, 2013

(51) Int. Cl.
*H01H 5/18* (2006.01)

(52) U.S. Cl.
USPC ..... 200/461

(58) Field of Classification Search
USPC ..... 200/467, 520, 284, 461
See application file for complete search history.

(56) References Cited

U.S. PATENT DOCUMENTS

| | | | | |
|---|---|---|---|---|
| 4,045,632 | A * | 8/1977 | Pierrot | 200/442 |
| 5,459,295 | A * | 10/1995 | Ohta et al. | 200/461 |
| 6,864,453 | B1 * | 3/2005 | Yu | 200/520 |
| 7,932,475 | B2 * | 4/2011 | Schnodt | 200/461 |
| 8,680,415 | B2 * | 3/2014 | Fang et al. | 200/461 |
| 2013/0231007 | A1 * | 9/2013 | Iwamoto et al. | 439/620.21 |

FOREIGN PATENT DOCUMENTS

| | | |
|---|---|---|
| CN | 202110987 U | 1/2012 |
| TW | 592380 U | 6/2004 |

* cited by examiner

*Primary Examiner* — Renee S Luebke
*Assistant Examiner* — Ahmed Saeed
(74) *Attorney, Agent, or Firm* — Muncy, Geissler, Olds & Lowe, P.C.

(57) ABSTRACT

A micro-switch provided labor-saving switching comprises a housing, a press member located on the housing, an actuation member located in the housing and a driving assembly located between the press member and actuation member. The press member is depressed to move reciprocally in the housing in a displacement. The driving member includes a force-bearing member hinged swivelably on the housing and at least one transmission member swivelable inversely against the force-bearing member. The force-bearing member includes a force-receiving portion in the displacement and an actuating portion connected to the force-receiving portion. The at least one transmission member includes a driven portion driven by the actuating portion and a force-applying portion connected to the driven portion. The driving assembly drives the actuation member through a lever principle to switch between a first conductive state and a second conductive state.

12 Claims, 6 Drawing Sheets

MICRO-SWITCH PROVIDED LABOR-SAVING SWITCHING

FIELD OF THE INVENTION

The present invention relates to a micro-switch and particularly to a micro-switch provided labor-saving switching through a plurality of levers.

BACKGROUND OF THE INVENTION

Micro-switch is a miniaturized switch with a transmission shaft formed in a selected shape on an outer side to receive an external force to perform switching operation. It generally includes features such as a small contact distance and an instant moving mechanism to provide mechanical ON/OFF through a set moving distance and action force, thus is often used to detect positioning status of machine movement.

A conventional micro-switch such as R.O.C. patent No. 592380 mainly includes an upper lid and a base. The micro-switch also includes a pushbutton, a common pin, an open-circuit pin and a conductive reed fastened to the common pin. One end of the conductive reed is depressible by the pushbutton so that another end of the conductive reed is moved downwards at the same time to connect the common pin and open-circuit pin to generate a switch signal. While it can provide circuit switch function, it relies merely on the conductive reed to bear the downward pressure and provide an elastic force. After used for a prolonged period, the reed tends to fatigue because of frequent bending up and down or even fracture, and could result in dysfunction of the micro-switch.

To remedy the aforesaid shortcoming, China utility patent CN202110987 discloses a micro-switch capable of withstanding a greater number of pressing, referring to FIG. 1. It comprises a housing 1, a plurality of conductive terminals 2 located on the housing 1, an elastic element 3, a conductive reed 4 and a pushbutton 5. The conductive reed 4 has a press-receiving portion 41 to receive pressing of the pushbutton 5, a contact portion 42 located between the conductive terminals 2, and at least one connection rib 43 to bridge the press-receiving portion 41 and contact portion 42. The elastic element 3 bridges the conductive reed 4 and conductive terminals 2. The conductive reed 4 is supported by the elastic element 3 in normal conditions. The elastic element 3 provides a bracing force for the conductive reed 4 to prevent it from incurring fatigue and fracturing caused by repetitive up and down swaying. Therefore the conductive reed 4 has a longer lifespan and can withstand a greater number of depressing.

Although the aforesaid technique resolves the problem of easy fatigue and fracturing of the conductive reed, and can withstand a greater number of pressing, it still has the following drawbacks remained to be overcome: when the pushbutton 5 is pushed downwards to press the press-receiving portion 41 the contact portion 42 also is moved downwards. As the conductive reed 4 is formed at a considerable length and thickness, a substantial push force has to be applied to the pushbutton 5 to sway the contact portion 42 to move to and fro at a sufficient distance to switch between different conductive states. To reduce the push force, one of the approaches is to reduce the thickness of the conductive reed 4 that is more difficult in fabrication and also results in decreasing of the lifespan of the conductive reed 4. Moreover, a great current often occurs during connection of the contact portion 42 and conductive reed 4 that generates a greater amount of heat on the contact surface between the contact portion 42 and conductive reed 4 and could cause melting of a portion of the contact portion 42 to stick to the conductive reed 4, then a greater force has to be applied to separate the contact portion 42 and conductive reed 4 to make the micro-switch function normally. Hence to overcome the sticking phenomenon is the prerequisite condition to reduce the press force needed for switching. This is still an issue remained to be resolved.

In addition to the considerations of increasing the lifespan of the micro-switch and reducing the press force for switching, a wide variety of specifications also are required in various industries to fabricate different types of precision machineries. Those varying specifications of micro-switches have specific moving distances and action forces. For instance, while reducing the thickness of the elastic reed can make the action force smaller, changing the moving distance involves assembly of a greater number of internal elements. Merely changing one element cannot meet the requirements of various specifications. Hence the producers have to make a greater number of molds that also makes the production higher. Thus how to change the moving distance of the micro-switch easier through a same production mold is another problem pending to be overcome.

SUMMARY OF THE INVENTION

The primary object of the present invention is to reduce press force needed in switching and overcome the disadvantage of dysfunction of micro-switch caused by the sticking phenomenon.

Another object of the invention is to resolve the shortcoming of making multiple sets of molds in response to varying micro-switch specifications.

To achieve the foregoing object the invention provides a micro-switch that provides labor-saving switching. It comprises a housing, a press member located on the housing, an actuation member located in the housing and a driving assembly located between the press member and actuation member. The housing has a housing compartment, at least one first conductive terminal and a common terminal extended outwards from the housing compartment. The actuation member has a butting portion close to the common terminal and a connecting portion remote from the common terminal. The connecting portion has a first conductive state connecting to the at least one first conductive terminal and a second conductive state without connecting to the at least one first conductive terminal. The press member has a displacement when pushed and moved reciprocally in the housing between an original position and a pressed position. The driving assembly includes a force-bearing member hinged on the housing in a swivelable manner and at least one transmission member hinged on the housing and being swivelable inversely against the force-bearing member. The force-bearing member includes a force-receiving portion located in the displacement and an actuating portion connected to the force-receiving portion. The at least one transmission member includes a driven portion driven by the actuating portion and a force-applying portion connected to the driven portion. The force-receiving portion receives being pressed by the press member to drive the force-applying portion swiveling inversely and push the butting portion so as to drive the connecting portion to switch between the first conductive state and second conductive state.

In one embodiment the force-bearing member includes a first pivoting portion bridged the force-receiving portion and actuating portion and hinged on the housing in a swivelable manner. The housing has at least one positioning hole. The first pivoting portion is a swivel shaft hinged in the positioning hole in a swivelable manner.

In another embodiment the force-bearing member includes a first pivoting portion bridged the force-receiving portion and actuating portion and hinged on the housing in a swivelable manner. The housing has at least one holding shaft. The first pivoting portion is a shaft sleeve hinged on the holding shaft in a swivelable manner.

In yet another embodiment the at least one transmission member includes a second pivoting portion bridged the driven portion and force-applying portion and hinged on the housing in a swivelable manner. The housing has at least one positioning hole. The second pivoting portion is a swivel shaft hinged in the positioning hole in a swivelable manner.

In yet another embodiment the at least one transmission member includes a second pivoting portion bridged the driven portion and force-applying portion and hinged on the housing in a swivelable manner. The housing has at least one positioning hole. The second pivoting portion is a swivel shaft hinged in the positioning hole in a swivelable manner. The housing has at least one holding shaft. The second pivoting portion is a shaft sleeve hinged on the holding shaft in a swivelable manner.

In yet another embodiment the actuating portion of the force-bearing member is coupled with the driven portion of the at least one transmission member.

In yet another embodiment the housing has a second conductive terminal in the housing compartment corresponding to the at least one first conductive terminal at a lower side, and the connecting portion is connected to the second conductive terminal in the second conductive state.

In yet another embodiment the press member includes a press portion and an elastic element bracing the press portion in normal conditions.

In yet another embodiment the housing includes a channel to allow the press portion to move reciprocally therein. The press portion has at least one retaining section at the bottom thereof formed with a size greater than the diameter of the channel In yet another embodiment the actuation member includes a bracing portion using the common terminal as a fulcrum to push the connecting portion to connect to the at least one first conductive terminal in normal conditions.

By means of the structure set forth above, compared with the conventional techniques, the micro-switch of the invention provides features as follow:

1. Reduce the press force needed for switching. The press member of the invention exploits the lever principle through the force-bearing member and transmission member, and can amplify a small press force to overcome sticking and maintain normal switch operation, thus improve sensitivity of the micro-switch to meet use requirements of precision machineries.

2. By changing the specification of the driving assembly various types of micro-switches with different displacements and actuation forces can be made. The displacement of the press member can be changed by adjusting the swivel displacement of the driving assembly. The swivel displacement is determined by many factors, such as the distance between the force-bearing member and transmission member, the lengths of the force-receiving portion and actuating portion of the force-bearing member, and the lengths of the driven portion and force-applying portion of the transmission member. Hence by adjusting those factors that affect the swivel displacement, micro-switches conforming to various displacement specifications can be made without making extra molds.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
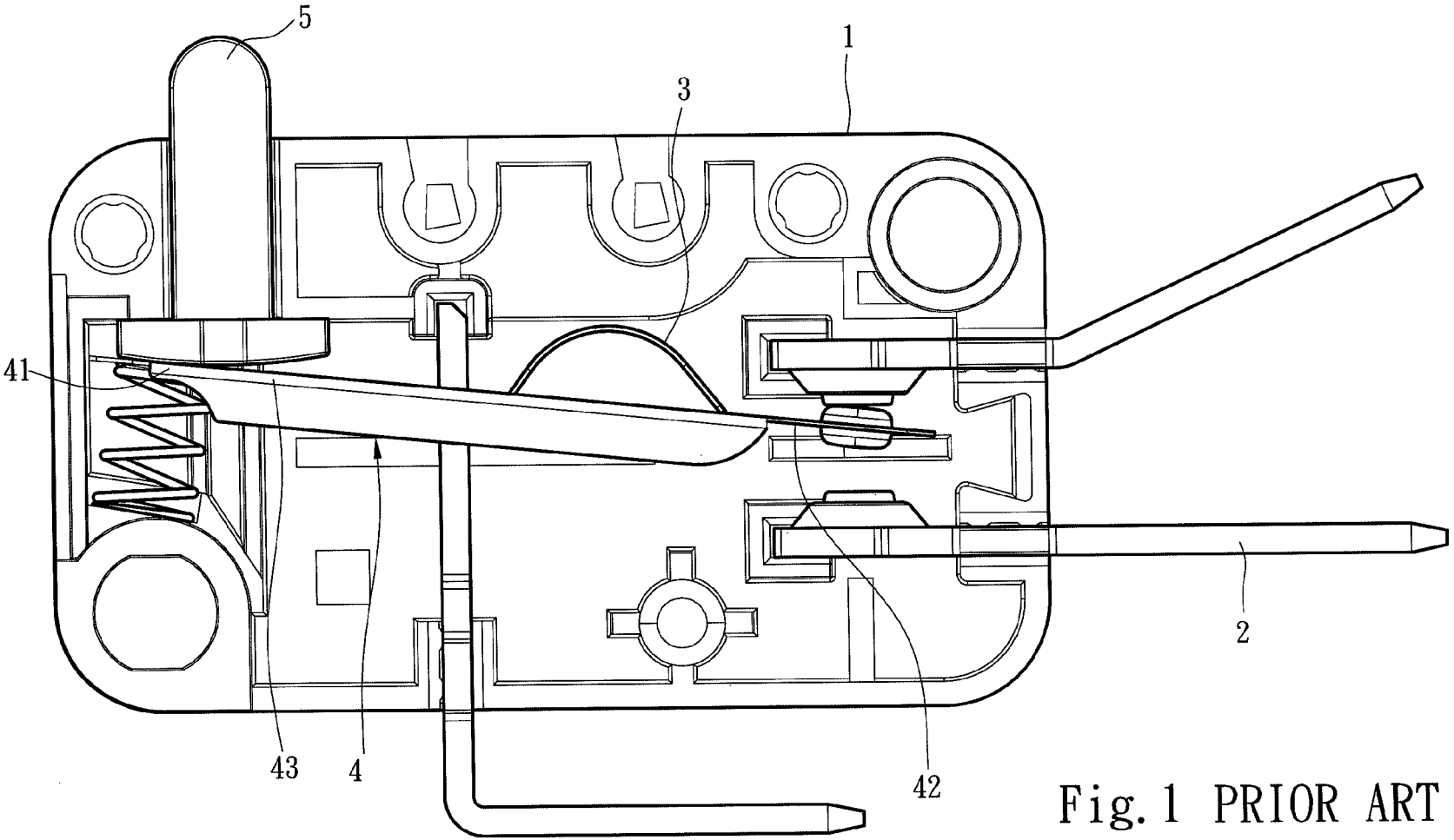
Fig. 1 PRIOR ART
FIG. 1 is a front view of the structure of a conventional micro-switch.
Figure 2:
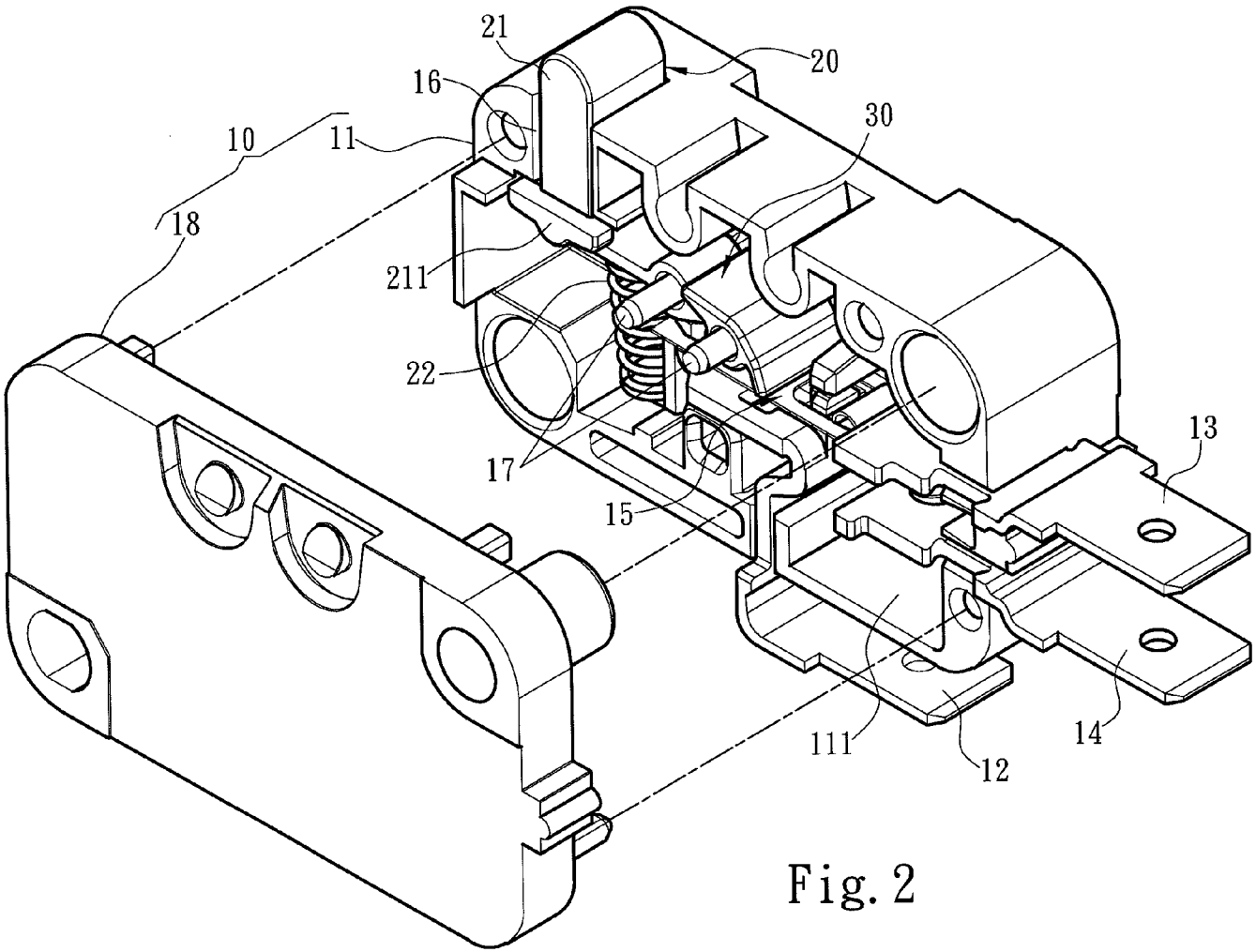
FIG. 2 is a schematic view of the structure of an embodiment of the invention.
Figure 3:
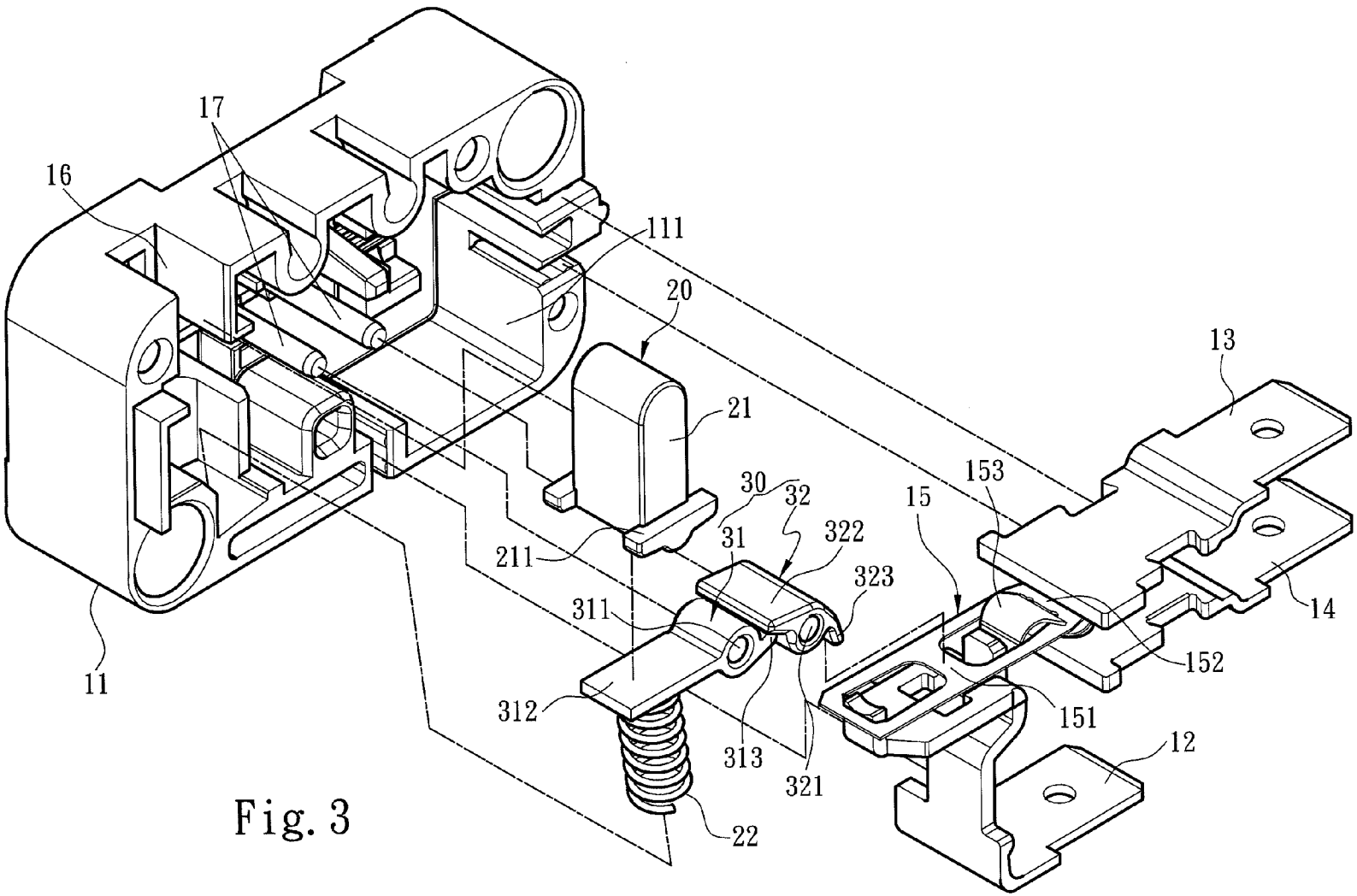
FIG. 3 is an exploded view of an embodiment of the invention.

Please refer to FIGS. 2 and 3 for an embodiment of the micro-switch provided labor-saving switching of the invention. It mainly includes a housing 10 and a press member 20 located on the housing 10. The housing 10 includes a holder 11 and a lid 18 to cover the holder 11. The holder 11 has a housing compartment 111 and a common terminal 12 and a first conductive terminal 13 extended outwards from the housing compartment 111, and also a second conductive terminal 14 in the housing compartment 111 corresponding to the first conductive terminal 13 at a lower side. The micro-switch in this embodiment is a Double-Throw type switch in terms of contact type, i.e. the terminals formed electric connection with outside circuits include a common terminal, a normally closed terminal and a normally opened terminal, but this is not the limitation of the invention, for instance, a normally-closed type and normally-open type also are adoptable. The housing 10 further has an actuation member 15 coupled on the common terminal 12 and a driving assembly 30 located between the press member 20 and actuation member 15. The press member 20 includes a press portion 21 and an elastic element 22 bracing the press member 21 in normal conditions and storing a return force when compressed by the press portion 21 while it is pushed. The housing 10 has a channel 16 to allow the press member 20 to move reciprocally therein in a displacement inside the housing 10 between an original position and a pressed position. To prevent the press member 20 from escaping the housing 10 the press portion 21 has a retaining section 211 at the bottom formed with a size greater than the diameter of the channel 17. In this embodiment, the first conductive terminal 13 is a normally-closed terminal and the second conductive terminal 14 is a normally-open terminal, but this is not the limitation of the invention.

Figure 4:
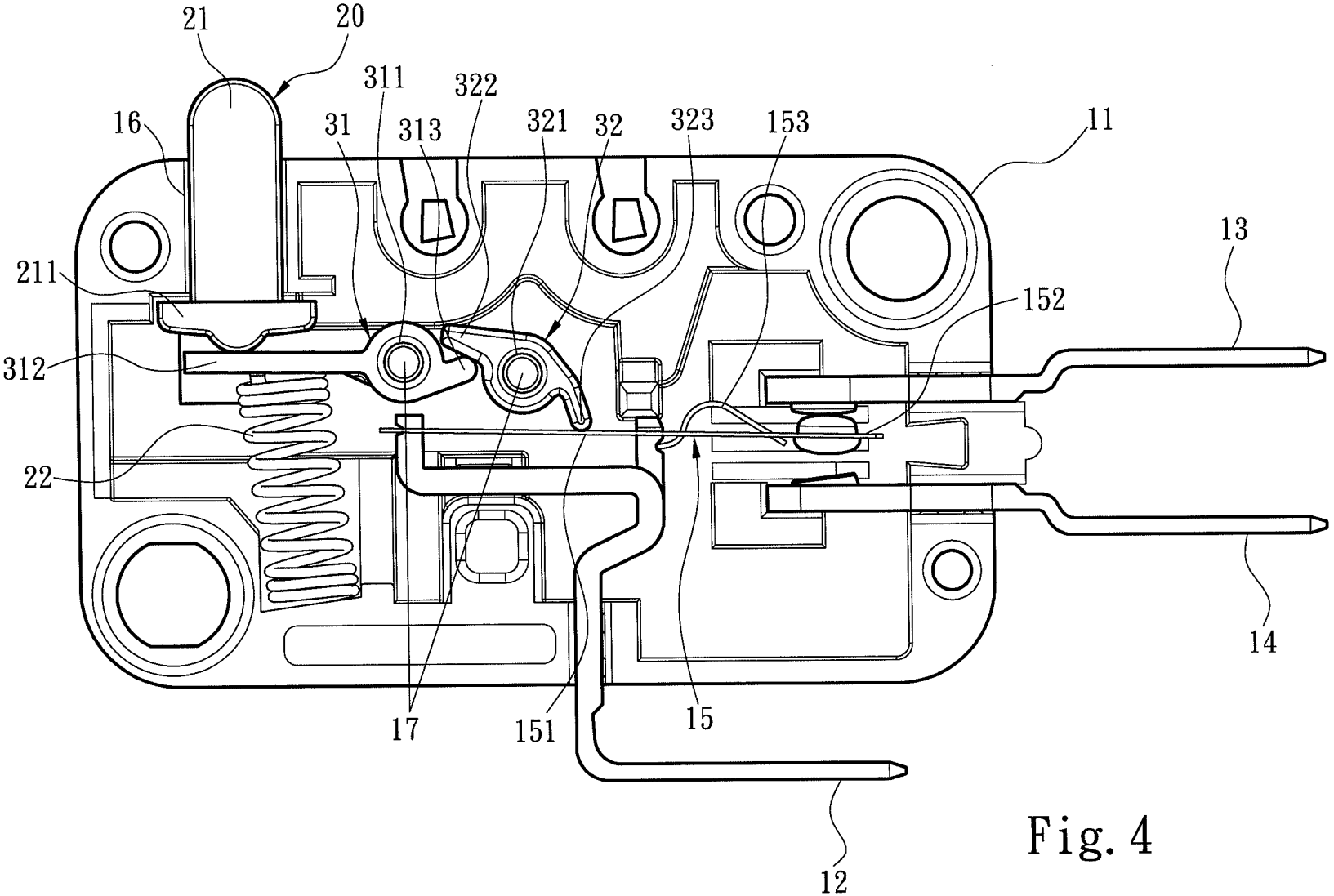
FIG. 4 is a front view of the structure of an embodiment of the invention.
Figure 6:
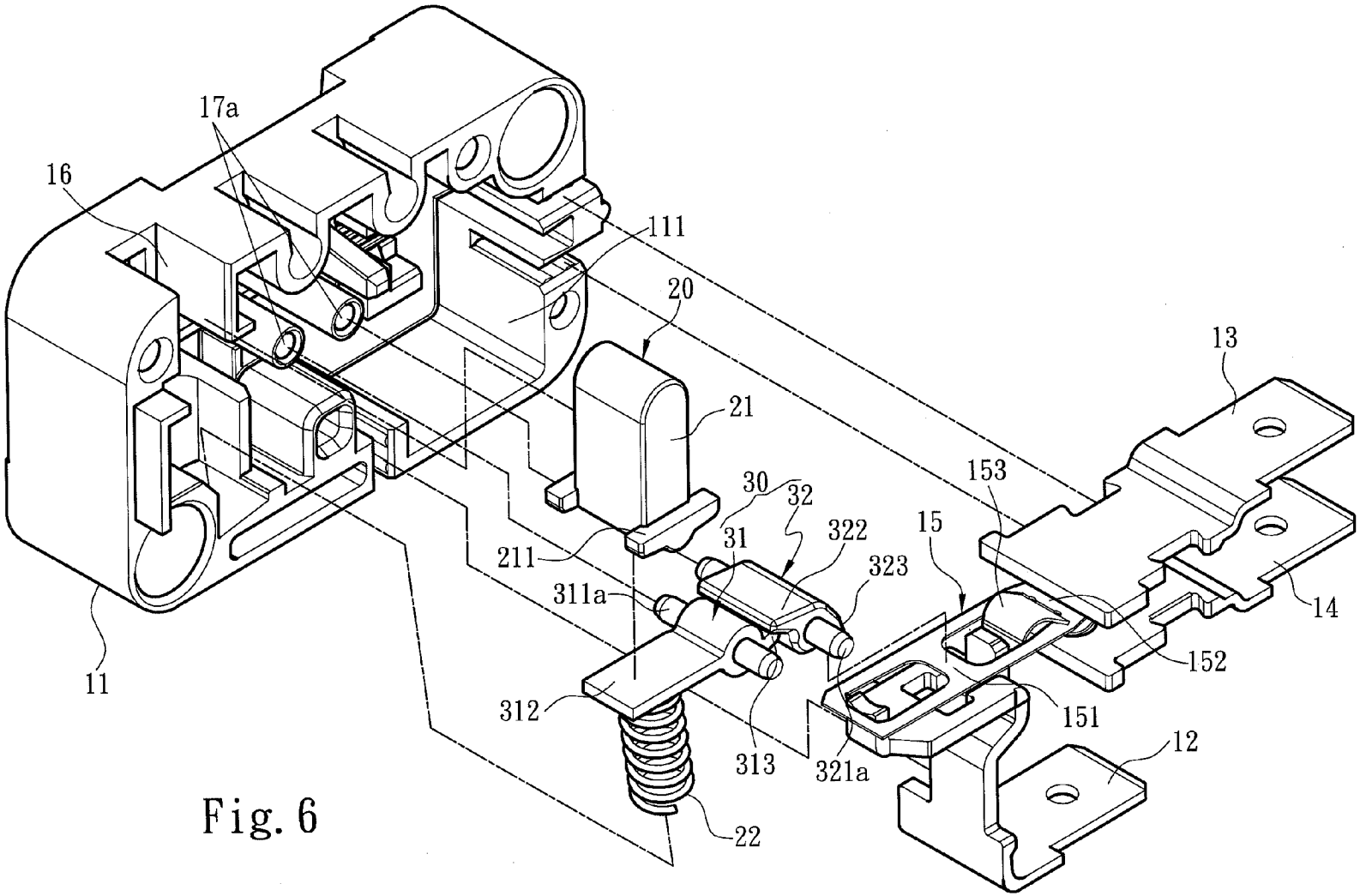
FIG. 6 is an exploded view of another embodiment of the invention.

Also referring to FIG. 4, the housing 10 also has two holding shafts 17. The driving assembly 30 has a force-bearing member 31 hinged on the housing 10 in a swivelable manner and at least one transmission member 32 hinged on the housing 10 and being swivelable inversely against the force-bearing member 31. The force-bearing member 31 includes a force-receiving portion 312 located in the displacement, an actuating portion 313 connected to the force-receiving portion 312 and a first pivoting portion 311 bridged the force-receiving portion 312 and actuating portion 313 and hinged on the housing 10 in a swivelable manner. The transmission member 32 includes a driven portion 322 driven by the actuating portion 313, a force-applying portion 323 connected to the driven portion 322 and a second pivoting portion 321 bridged the driven portion 322 and force-applying portion 323 and hinged on the housing 10. Preferably, the actuating portion 313 of the force-bearing member 31 is coupled with the driven portion 322 of the transmission member 32. However, other embodiments may also be adopted with the force-bearing member 31 not directly coupling with the transmission member 32, but bridging the actuating portion 313 and driven portion 322 via a transmission element (not shown in the drawings) located between them, such as a gear set. In addition, in this embodiment the actuation member 15 has a butting portion 151 close to the common terminal 12 and a connecting portion 152 remote from the common terminal 12. The actuation member 15 further includes a bracing portion 153 with a fulcrum on the common terminal 12 to press the connecting portion 152 to connect to the first conductive terminal 13 in normal conditions. It is to be noted that in this embodiment the housing 10 has two holding shafts 17 to be coupled in a swivelable manner with the first and second pivoting portions 311 and 321 that are formed respectively in a shaft sleeve, but this is not the limitation of the invention, other alternative embodiments may also be adopted. Please refer to FIG. 6 for another embodiment of the invention. In this embodiment the housing 10 includes a positioning hole 17*a*, and the pivoting portions 311*a* and 321*a* are swivel shafts hinged in the positioning hole 17*a* in a swivelable manner. Other elements and structure are same as the aforesaid embodiment, thus details are omitted.

Referring to FIG. 4 again, when the press portion 21 is not being pushed downwards the elastic element 22 provides an elastic force to push the force-receiving portion 312 upwards to move the actuating portion 313 away from the driven portion 322, as the driven portion 322 is not driven by the actuating portion 313 the force-applying portion 323 of the transmission member 32 does not contact or merely lightly contacts the butting portion 151 of the actuation member 15, hence the common terminal 12 serves as the fulcrum of the bracing portion 153 which provides an elastic force to push the connecting portion 152 to connect to the first conductive terminal 13 in normal conditions to form a first conductive state in which the common terminal 12 and first conductive terminal 13 are connected. In this embodiment the second conductive terminal 14 is a normally-closed terminal, hence at the first conductive state the micro-switch does not generate a switching signal to the load at the rear end.

Figure 5:
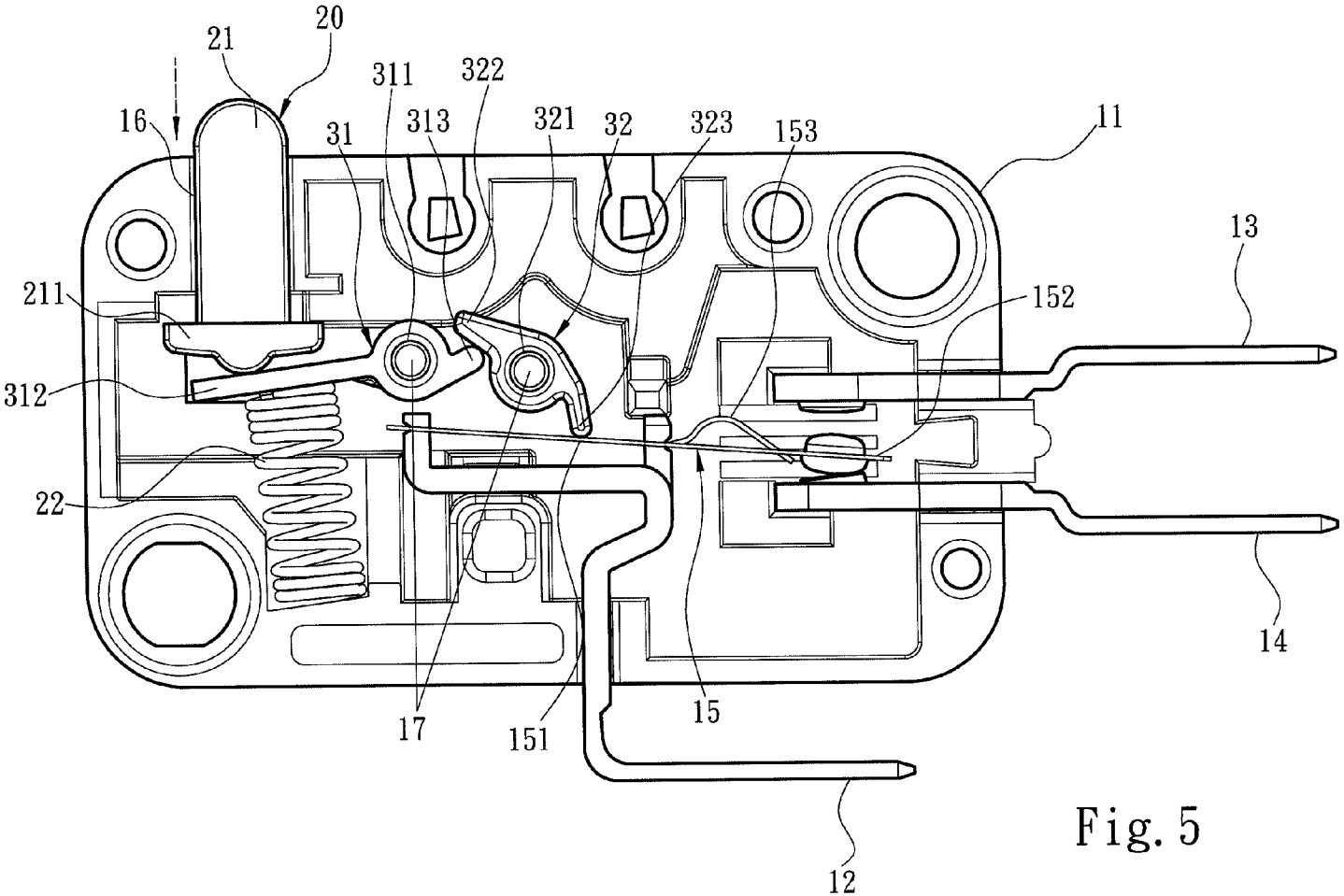
FIG. 5 is a schematic view of an embodiment of the invention in an operating condition.

Please refer to FIG. 5 for an embodiment of the invention in a use condition. When the press portion 21 is pushed downwards from the original position to the pressed position the force-receiving portion 312 in the displacement is pushed downwards to compress the elastic element 22, and the actuating portion 313 is driven by the force-receiving portion 312 to swivel counterclockwise about the first pivoting portion 311 and moves upwards to push the driven portion 322; meanwhile, the force-applying portion 323 is driven by the driven portion 322 to swivel clockwise about the second pivoting portion 321 to push the butting portion 151 downwards; as the push force is greater than the downward elastic force provided by the bracing portion 153, the connecting portion 152 also is moved downwards with the butting portion 151 and escapes the first conductive terminal 13 and connects to the second conductive terminal 14, therefore the common terminal 12 and second conductive terminal 14 are connected to form the second conductive state. Holistically, the force-bearing member 31 is pushed by the press portion 21 and swivels clockwise, while the transmission member 32 swivels counterclockwise against the force-bearing member 31, the force-receiving portion 312 is pressed by the press portion 21 to drive the force-applying portion 323 to swivel counterclockwise and press the butting portion 151 which in turn drives the connecting portion 152 to switch between the first conductive state and second conductive state. In this embodiment the second conducive terminal 14 is the normally-open terminal, hence at the second conductive state the micro-switch generate a switch signal sent to the load at the rear end.

The mechanism depicted in FIGS. 4 and 5 can be interpreted as an application adopted the double-lever principle. The force-bearing member 31 serves as a first lever with the first pivoting portion 311 as a first fulcrum and the force-receiving portion 312 and actuating portion 313 as first force applying arms at two ends of the first fulcrum, and the transmission member 32 serves as a second lever with the second pivoting portion 321 as a second fulcrum and the driven portion 322 and force-applying portion 323 as second force applying arms at two ends of the second fulcrum. The actuating portion 313 is coupled on the driven portion 322 to generate linkage movements of the first and second levers. By adjusting the length of the force applying arms a labor-saving micro-switch can be designed. For instance, if the length of the force-receiving portion 312 is much longer than the force-applying portion 323, according to the physical principle of same torsional moment on the coupled first lever and second lever, the force applied on the force-receiving portion 312 can generate a multiplication effect on the force-applying portion 323. Hence by pressing the press portion 21 with a small force an amplified force can be generated on the force-applying portion 323 to push the butting portion 151 to drive the connecting portion 152 to sway up and down. Thereby the press force needed for switching can be reduced while also overcome the sticking problem.

Furthermore, the press portion 21 drives the connecting portion 152 to sway up and down via the driving assembly 30 consisting of the force-bearing member 31 and transmission member 32 and is moved in the channel 16 at a distance which can be changed by adjusting the swivel displacement of the driving assembly 30. The swivel displacement of the driving assembly 30 is determined by many factors, such as the distance between the force-bearing member 31 and transmission member 32, the lengths of the force-receiving portion 312 and actuating portion 313, and the lengths of the driven portion 322 and force-applying portion 323. Therefore adjusting the aforesaid factors that affect the swivel displacement can attain desired movements of various specifications of micro-switch without the need of making molds anew.

As a conclusion, the micro-switch of the invention provides a driving assembly between the press member and actuation member. The driving assembly includes a force-bearing member hinged on the housing and at least one transmission member swiveling inversely against the force-bearing member. The force-bearing member has a force-receiving portion in the displacement and an actuation member connected to the force-receiving portion. The transmission member has a driven portion connected to the actuating portion and a force-applying portion connected to the driven portion. Through the structure previously discussed the press member can drive the connecting portion via the driving assembly to switch between a first conductive state and a second conductive state. Compared with the conventional techniques, the micro-switch of the invention employs the lever principle, thus can switch via a small force.

Moreover, the specification of the driving assembly can be changed as desired to make the micro-switch to equip with varying displacements and action forces to meet special use requirements. It provides significant improvements over the conventional techniques.

While the preferred embodiments of the invention have been set forth for the purpose of disclosure, they are not the limitations of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A micro-switch provided labor-saving switching, comprising:

a housing including a housing compartment, at least one first conductive terminal and a common terminal extended outwards from the housing compartment, and an actuation member coupled on the common terminal, the actuation member including a butting portion close to the common terminal and a connecting portion remote from the common terminal, the connecting portion including a first conductive state connecting to the at least one first conductive terminal and a second conductive state without connecting to the at least one first conductive terminal;

a press member which is located on the housing and depressible to move reciprocally in a displacement inside the housing between an original position and a pressed position; and a driving assembly which is located between the press member and the actuation member, the driving assembly includes a force-bearing member hinged on the housing in a swivelable manner and at least one transmission member hinged on the housing and being swivelable inversely against the force-bearing member, the force-bearing member including a force-receiving portion located in the displacement and an actuating portion connected to the force-receiving portion, the at least one transmission member including a driven portion driven by the actuating portion and a force-applying portion connecting to the driven portion, the force-receiving portion being pressed by the press member to drive the force-applying portion swiveling inversely to press the butting portion so as to drive the connecting portion to switch between the first conductive state and the second conductive state.

2. The micro-switch of claim 1, wherein the force-bearing member includes a first pivoting portion bridged the force-receiving portion and the actuating portion and hinged on the housing in a swivelable manner.

3. The micro-switch of claim 1, wherein the at least one transmission member includes a second pivoting portion bridged the driven portion and the force-applying portion and hinged on the housing in a swivelable manner.

4. The micro-switch of claim 2, wherein the housing includes at least one positioning hole and the first pivoting portion is a swivel shaft hinged in the positional hole in a swivelable manner.

5. The micro-switch of claim 3, wherein the housing includes at least one positioning hole and the second pivoting portion is a swivel shaft hinged in the positional hole in a swivelable manner.

6. The micro-switch of claim 2, wherein the housing includes at least one holding shaft and the first pivoting portion is a shaft sleeve coupled on the holding shaft in a swivelable manner.

7. The micro-switch of claim 3, wherein the housing includes at least one holding shaft and the second pivoting portion is a shaft sleeve coupled on the holding shaft in a swivelable manner.

8. The micro-switch of claim 1, wherein the actuating portion of the force-bearing member is coupled on the driven portion of the at least one transmission member.

9. The micro-switch of claim 1, wherein the housing includes a second conductive terminal in the housing compartment corresponding to the at least one first conductive terminal at a lower side, the connecting portion connecting to the second conductive terminal in the second conductive state.

10. The micro-switch of claim 1, wherein the press member includes a press portion and an elastic element bracing the press portion in normal conditions.

11. The micro-switch of claim 10, wherein the housing includes a channel to allow the press portion to move reciprocally therein, the press portion including at least one retaining section at the bottom thereof formed with a size greater than the diameter of the channel.

12. The micro-switch of claim 1, wherein the actuation member includes a bracing portion using the common terminal as a fulcrum to push the connecting portion to connect to the at least one first conductive terminal in normal conditions.

* * * * *